US009903306B2

(12) United States Patent
Carey et al.

(10) Patent No.: US 9,903,306 B2
(45) Date of Patent: Feb. 27, 2018

(54) SYSTEM AND METHOD FOR ACQUIRING PRESSURE DATA FROM A FUEL ACCUMULATOR OF AN INTERNAL COMBUSTION ENGINE

(71) Applicant: CUMMINS INC., Columbus, IN (US)

(72) Inventors: David M. Carey, Greenwood, IN (US); Paul V. Moonjelly, Columbus, IN (US)

(73) Assignee: CUMMINS INC., Columbus, IN (US)

( * ) Notice: Subject to any disclaimer, the term of this patent is extended or adjusted under 35 U.S.C. 154(b) by 520 days.

(21) Appl. No.: 13/763,514

(22) Filed: Feb. 8, 2013

(65) Prior Publication Data

US 2014/0224219 A1 Aug. 14, 2014

(51) Int. Cl.

| | |
|---|---|
| ***F02D 41/38*** | (2006.01) |
| ***F02M 65/00*** | (2006.01) |
| *F02D 41/22* | (2006.01) |

(52) U.S. Cl.

CPC ..... *F02D 41/3845* (2013.01); *F02M 65/001* (2013.01); *F02D 41/221* (2013.01); *F02D 2200/0602* (2013.01); *F02D 2200/0616* (2013.01)

(58) Field of Classification Search

CPC .. F02D 41/221; F02D 41/226; F02D 41/2467; F02D 41/3845; F02D 2200/0602; F02D 2200/0616; F02D 41/2429; F02D 41/2451; F02D 41/2464–41/247; F02D 41/3836–41/3863; F02M 65/001; F02M 63/0225; F02M 63/023; F02M 63/024; F02M 63/0245; F02M 65/00–65/005

USPC ..... 73/114.43, 114.45, 114.51; 123/446, 123/456, 457, 497, 510, 511; 701/101–104

See application file for complete search history.

(56) References Cited

U.S. PATENT DOCUMENTS

| | | | | |
|---|---|---|---|---|
| 4,884,545 | A | 12/1989 | Mathis | |
| 4,903,669 | A | 2/1990 | Groff et al. | |
| 5,176,122 | A * | 1/1993 | Ito | F02D 41/2438 123/447 |
| 5,201,296 | A | 4/1993 | Wunning et al. | |
| 5,261,366 | A | 11/1993 | Regueiro | |
| 5,445,019 | A | 8/1995 | Glidewell et al. | |

(Continued)

OTHER PUBLICATIONS

International Search Report and Written Opinion dated May 30, 2014 in corresponding International Application No. PCT/US14/15196.

(Continued)

*Primary Examiner* — Stephen K Cronin
*Assistant Examiner* — Robert Werner
(74) *Attorney, Agent, or Firm* — Faegre Baker Daniels LLP

(57) ABSTRACT

A system and method for measuring fuel pressure decreases in a fuel accumulator caused by a fuel injector of an internal combustion engine is provided. The system includes the ability to stop a fuel flow to a fuel accumulator of the engine. Pressure signals are transmitted to a control system of the engine until the fuel pressure in the fuel accumulator drops by a predetermined amount, at which time fuel flow is re-enabled. The pressure signals are then analyzed to determine the amount or quantity of fuel delivered by each fuel injector. The system and method maintain engine and emissions performance by limiting the amount of fuel pressure decrease in the fuel accumulator.

21 Claims, 6 Drawing Sheets

(56) References Cited

U.S. PATENT DOCUMENTS

| | | | | |
|---|---|---|---|---|
| 5,535,621 | A | 7/1996 | Glidewell et al. | |
| 5,549,087 | A * | 8/1996 | Gray, Jr. | F02B 23/0603 123/254 |
| 5,806,490 | A | 9/1998 | Nogi et al. | |
| 6,088,647 | A * | 7/2000 | Hemberger et al. | 701/104 |
| 6,105,554 | A | 8/2000 | Nishiyama | |
| 6,557,530 | B1 | 5/2003 | Benson et al. | |
| 6,561,164 | B1 | 5/2003 | Mollin | |
| 6,567,758 | B1 | 5/2003 | Wuori | |
| 6,675,638 | B2 | 1/2004 | Pfitz | |
| 6,694,953 | B2 | 2/2004 | Barnes et al. | |
| 6,705,290 | B2 * | 3/2004 | Puckett | 123/446 |
| 6,981,489 | B2 | 1/2006 | Petrone et al. | |
| 7,027,907 | B2 | 4/2006 | LeGall et al. | |
| 7,093,586 | B2 | 8/2006 | Mattes | |
| 7,188,608 | B2 | 3/2007 | Wilson et al. | |
| 7,210,459 | B2 | 5/2007 | Shibata | |
| 7,249,596 | B2 | 7/2007 | Pellizzari et al. | |
| 7,257,511 | B1 | 8/2007 | Hsieh et al. | |
| 7,299,790 | B2 | 11/2007 | Okamoto et al. | |
| 7,421,329 | B2 | 9/2008 | Bowling et al. | |
| 7,558,665 | B1 * | 7/2009 | Geveci | F02D 41/2438 123/447 |
| 7,606,655 | B2 | 10/2009 | Husted et al. | |
| 7,610,901 | B2 | 11/2009 | Bucher et al. | |
| 7,628,146 | B2 | 12/2009 | Kloppenburg et al. | |
| 7,650,778 | B2 * | 1/2010 | Puckett et al. | 73/114.41 |
| 7,717,088 | B2 * | 5/2010 | Thomas | 123/478 |
| 7,779,816 | B2 | 8/2010 | Doelker | |
| 7,788,015 | B2 | 8/2010 | Geveci et al. | |
| 7,789,068 | B2 | 9/2010 | Serra et al. | |
| 7,827,963 | B2 | 11/2010 | Li et al. | |
| 7,835,850 | B2 | 11/2010 | Nakata et al. | |
| 7,841,319 | B2 * | 11/2010 | Thomas | F02D 41/2438 123/478 |
| 7,980,120 | B2 * | 7/2011 | Cinpinski et al. | 73/114.43 |
| 8,047,175 | B2 | 11/2011 | Nishi et al. | |
| 8,100,112 | B2 | 1/2012 | Nakata et al. | |
| 8,109,091 | B2 * | 2/2012 | Xiao | F02B 37/24 123/568.21 |
| 8,118,006 | B2 * | 2/2012 | Pursifull | F02D 41/0027 123/299 |
| 8,789,511 | B2 | 7/2014 | Sakata | |
| 8,985,088 | B2 * | 3/2015 | Blythe | F02D 41/1497 123/198 F |
| 9,169,784 | B2 | 10/2015 | Moonjelly et al. | |
| 2003/0051709 | A1 | 3/2003 | Yu | |
| 2004/0055576 | A1 | 3/2004 | McCarthy | |
| 2004/0134268 | A1 | 7/2004 | Tuken et al. | |
| 2004/0149253 | A1 | 8/2004 | Kikuchi et al. | |
| 2004/0194762 | A1 | 10/2004 | Okamoto | |
| 2005/0061297 | A1 | 3/2005 | Oono | |
| 2005/0126538 | A1 | 6/2005 | Warne et al. | |
| 2006/0107929 | A1 | 5/2006 | Yamamoto | |
| 2006/0107972 | A1 | 5/2006 | Yamamoto | |
| 2007/0079808 | A1 | 4/2007 | Takahashi | |
| 2007/0079809 | A1 | 4/2007 | Oono | |
| 2008/0059039 | A1 | 3/2008 | Nakagawa et al. | |
| 2008/0216797 | A1 | 9/2008 | Oono | |
| 2008/0236547 | A1 | 10/2008 | Takahashi et al. | |
| 2009/0020630 | A1 | 1/2009 | Yan | |
| 2009/0095244 | A1 | 4/2009 | Leone et al. | |
| 2009/0177366 | A1 | 7/2009 | Achleitner et al. | |
| 2009/0188472 | A1 | 7/2009 | Ulrey et al. | |
| 2009/0241642 | A1 | 10/2009 | Kyllingstad | |
| 2009/0255503 | A1 | 10/2009 | Fujiwara | |
| 2010/0147058 | A1 | 6/2010 | Cinpinski et al. | |
| 2010/0250102 | A1 | 9/2010 | Imai et al. | |
| 2011/0030655 | A1 | 2/2011 | Keneko | |
| 2011/0041808 | A1 | 2/2011 | Li | |
| 2011/0232610 | A1 | 9/2011 | Okamoto | |
| 2011/0253106 | A1 | 10/2011 | Bartsch et al. | |
| 2013/0000606 | A1 | 1/2013 | Watanabe et al. | |
| 2013/0013174 | A1 | 1/2013 | Nistler et al. | |
| 2013/0013175 | A1 | 1/2013 | Nistler et al. | |
| 2014/0224218 | A1 | 8/2014 | Carey et al. | |
| 2014/0224219 | A1 | 8/2014 | Carey et al. | |
| 2014/0224223 | A1 | 8/2014 | Benson et al. | |
| 2015/0020777 | A1 | 1/2015 | Carey et al. | |

OTHER PUBLICATIONS

International Search Report dated May 22, 2014 in corresponding International Application No. PCT/US14/15115, 1 page.

International Search Report dated Oct. 22, 2014 in corresponding International Application No. PCT/US14/46967, 1 page.

Engine-Operating Load Influences Diesel Exhaust Composition and Cardiopulmonary and Immune Responses, Environ Health Perspectives, http://dx.doi.org/10.1289/ehp.1003101, available online as early as Apr. 25, 2011, 13 pages.

Service Letter SL09-511/MTS, MAN Diesel, available May 2009, 7 pages.

Proceedings of the FISITA World Automotive Congress, vol. 2, Sep. 2008, 1 page.

First Office Action issued by the State Intellectual Property Office of People's Republic of China, dated Apr. 5, 2017, for related Chinese Application No. 201480007751.4; 15 pages.

* cited by examiner

SYSTEM AND METHOD FOR ACQUIRING PRESSURE DATA FROM A FUEL ACCUMULATOR OF AN INTERNAL COMBUSTION ENGINE

TECHNICAL FIELD

This disclosure relates to a system and method for acquiring pressure data from a fuel accumulator of an internal combustion engine.

BACKGROUND

As with all mechanical devices, fuel injectors have physical dimensions that lead to variations between fuel injectors. In addition, each fuel injector has different rates of wear and responds to temperature changes differently. Since the fuel delivered by each fuel injector during a fuel injection event varies enough to affect the performance of an associated engine, it is useful to measure or calculate the fuel delivery by each fuel injector. Current systems stop fuel flow to a fuel accumulator for a specific time, leading to performance and emission challenges when the fuel pressure in the accumulator falls to a level that affects fuel injection.

SUMMARY

This disclosure provides a system for determining a fuel quantity delivered to a plurality of combustion chambers by a fuel system of an internal combustion engine, the system comprising a fuel accumulator, a sensor, a plurality of fuel injectors, and a control system. The fuel accumulator is positioned to receive a fuel flow. The pressure sensor is adapted to detect fuel pressure in the fuel accumulator and to transmit a pressure signal indicative of the fuel pressure in the fuel accumulator. Each fuel injector is operable to deliver a quantity of fuel from the fuel accumulator to one of the plurality of combustion chambers. The control system is adapted to receive the pressure signal, to transmit a control signal to stop the fuel flow to the fuel accumulator, and to analyze the pressure signal to determine the quantity of fuel delivered by one or more of the plurality of fuel injectors. The control system is further adapted to transmit a control signal to restart the fuel flow to the fuel accumulator after the fuel pressure in the fuel accumulator has decreased by a predetermined amount.

This disclosure also provides a method of determining an amount of fuel injected by a fuel injector of an internal combustion engine. The method comprises providing a fuel flow to a fuel accumulator, stopping the fuel flow to the fuel accumulator to define a beginning of a termination event, and determining a fuel pressure in the fuel accumulator during the termination event. The method further comprises restarting the fuel flow to the fuel accumulator when the fuel pressure in the fuel accumulator decreases by a predetermined amount, defining an end of the termination event, and determining the amount of fuel delivered by the fuel injector during a fuel injection event from the fuel pressure.

Advantages and features of the embodiments of this disclosure will become more apparent from the following detailed description of exemplary embodiments when viewed in conjunction with the accompanying drawings.

DETAILED DESCRIPTION

Figure 1:
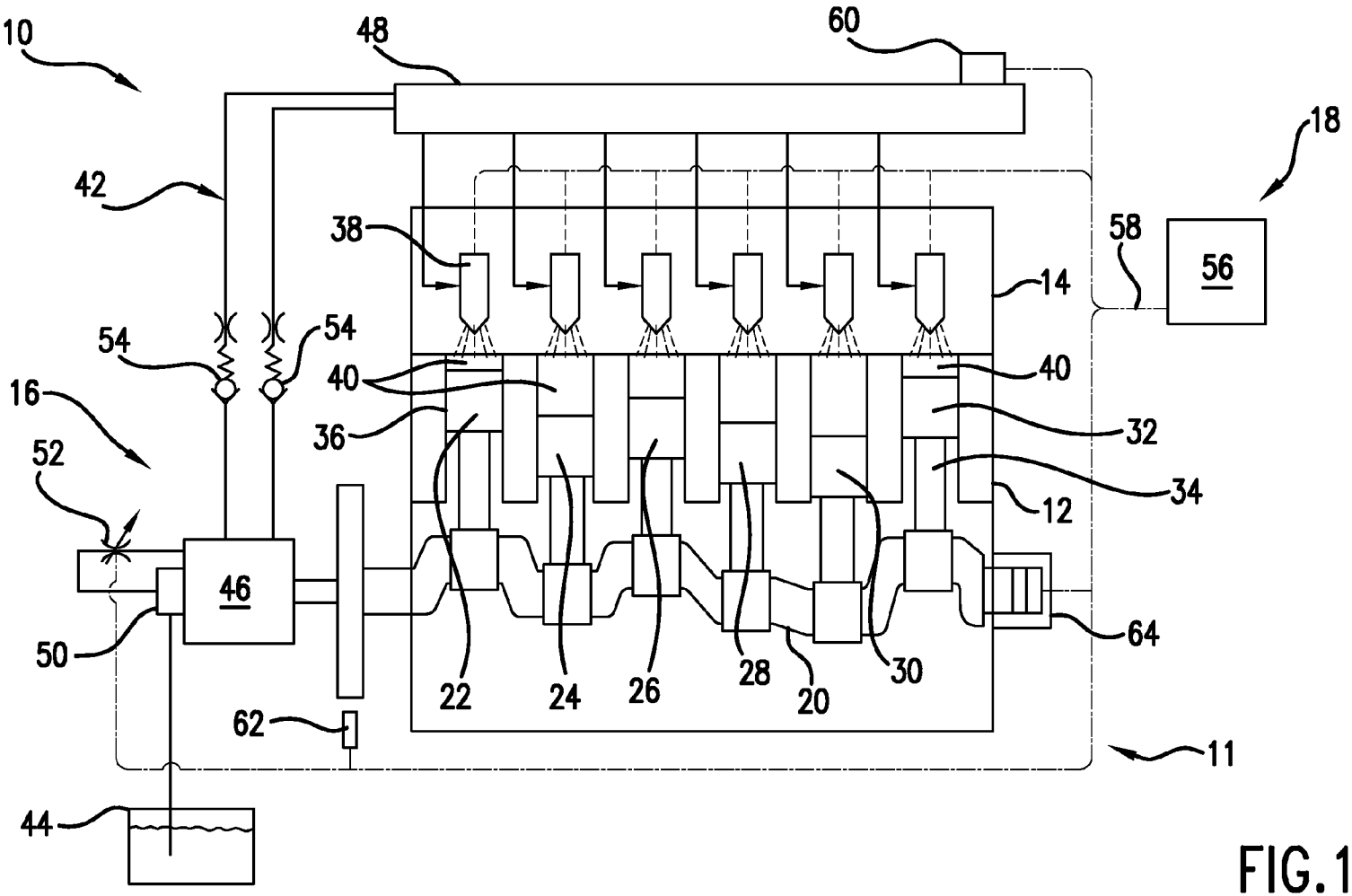
FIG. 1 is a schematic of an internal combustion engine incorporating an exemplary embodiment of the present disclosure.

Referring to FIG. 1, a portion of a conventional internal combustion engine is shown as a simplified schematic and generally indicated at 10. Engine 10 includes an engine body 11, which includes an engine block 12 and a cylinder head 14 attached to engine block 12, a fuel system 16, and a control system 18. Control system 18 receives signals from sensors located on engine 10 and transmits control signals to devices located on engine 10 to control the function of those devices, such as one or more fuel injectors.

One challenge with fuel injectors is that they have a measure of variability from injector to injector because of dimensional tolerances, assembly variations, and wear over time. These variations lead to variations in fuel quantity delivered, which cause undesirable variations in output power in engine 10 and causes undesirable variation in emissions, e.g., NOX and CO. In order to combat these undesirable effects, techniques of measuring fuel delivery by each fuel injector have been developed. However, these techniques have their own undesirable side effects. One technique that avoids the use of individual flow measurements is to measure the pressure decrease in a fuel accumulator while fuel flow to the fuel accumulator is stopped for a specific time. However, this technique can lead to an undesirable drop in fuel pressure in the fuel accumulator. The apparatus and method described hereinbelow provides measurements of fuel flow from each fuel injector during an injection event while preventing an undesirable drop in fuel pressure in the fuel accumulator. Control system 18 is able to stop the flow of fuel to a fuel accumulator or rail of engine 10. While the fuel flow to the fuel accumulator is stopped, which forms a termination event, control system 18 receives signals from a pressure sensor associated with the fuel accumulator indicative of the fuel pressure in the fuel accumulator. By ceasing fuel flow based on a fuel pressure decrease in the accumulator rather than time, the performance and emissions of engine 10 are maintained.

Engine body 12 includes a crank shaft 20, a #1 piston 22, a #2 piston 24, a #3 piston 26, a #4 piston 28, a #5 piston 30, a #6 piston 32, and a plurality of connecting rods 34. Pistons 22, 24, 26, 28, 30, and 32 are positioned for reciprocal movement in a plurality of engine cylinders 36, with one piston positioned in each engine cylinder 36. One connecting rod 34 connects each piston to crank shaft 20. As will be seen, the movement of the pistons under the action of a combustion process in engine 10 causes connecting rods 34 to move crankshaft 20.

A plurality of fuel injectors 38 are positioned within cylinder head 14. Each fuel injector 38 is fluidly connected to a combustion chamber 40, each of which is formed by one piston, cylinder head 14, and the portion of engine cylinder 36 that extends between the piston and cylinder head 14.

Fuel system 16 provides fuel to injectors 38, which is then injected into combustion chambers 40 by the action of fuel injectors 38, forming an injection event. Fuel system 16 includes a fuel circuit 42, a fuel tank 44, which contains a fuel, a high-pressure fuel pump 46 positioned along fuel circuit 42 downstream from fuel tank 44, and a fuel accumulator or rail 48 positioned along fuel circuit 42 downstream from high-pressure fuel pump 46. While fuel accumulator or rail 48 is shown as a single unit or element, accumulator 48 may be distributed over a plurality of elements that transmit or receive high-pressure fuel, such as fuel injector(s) 38, high-pressure fuel pump 46, and any lines, passages, tubes, hoses and the like that connect high-pressure fuel to the plurality of elements. Injectors 38 receive fuel from fuel accumulator 48. Fuel system 16 also includes an inlet metering valve 52 positioned along fuel circuit 42 upstream from high-pressure fuel pump 46 and one or more outlet check valves 54 positioned along fuel circuit 42 downstream from high-pressure fuel pump 46 to permit one-way fuel flow from high-pressure fuel pump 46 to fuel accumulator 48. Though not shown, additional elements may be positioned along fuel circuit 42. For example, inlet check valves may be positioned downstream from inlet metering valve 52 and upstream from high-pressure fuel pump 46, or inlet check valves may be incorporated in high-pressure fuel pump 46. Inlet metering valve 52 has the ability to vary or shut off fuel flow to high-pressure fuel pump 46, which thus shuts off fuel flow to fuel accumulator 48. Fuel circuit 42 connects fuel accumulator 48 to fuel injectors 38, which then provide controlled amounts of fuel to combustion chambers 40. Fuel system 16 may also include a low-pressure fuel pump 50 positioned along fuel circuit 42 between fuel tank 44 and high-pressure fuel pump 46. Low-pressure fuel pump 50 increases the fuel pressure to a first pressure level prior to fuel flowing into high-pressure fuel pump 46, which increases the efficiency of operation of high-pressure fuel pump 46.

Control system 18 may include a control module 56 and a wire harness 58. Many aspects of the disclosure are described in terms of sequences of actions to be performed by elements of a computer system or other hardware capable of executing programmed instructions. It will be recognized that in each of the embodiments, the various actions could be performed by specialized circuits (e.g., discrete logic gates interconnected to perform a specialized function), by program instructions (software), such as program modules, being executed by one or more processors, or by a combination of both. Moreover, the disclosure can additionally be considered to be embodied within any form of computer readable carrier, such as solid-state memory, magnetic disk, and optical disk containing an appropriate set of computer instructions, such as program modules, and data structures that would cause a processor to carry out the techniques described herein. A computer-readable medium may include the following: an electrical connection having one or more wires, magnetic disk storage, magnetic cassettes, magnetic tape or other magnetic storage devices, a portable computer diskette, a random access memory (RAM), a read-only memory (ROM), an erasable programmable read-only memory (EPROM or Flash memory), or any other medium capable of storing information. It should be noted that the system of the present disclosure is illustrated and discussed herein as having various modules and units that perform particular functions. It should be understood that these modules and units are merely schematically illustrated based on their function for clarity purposes, and do not necessarily represent specific hardware or software. In this regard, these modules, units and other components may be hardware and/or software implemented to substantially perform their particular functions explained herein. The various functions of the different components can be combined or segregated as hardware and/or software modules in any manner, and can be useful separately or in combination. Thus, the various aspects of the disclosure may be embodied in many different forms, and all such forms are contemplated to be within the scope of the disclosure.

Control system 18 also includes an accumulator pressure sensor 60 and a crank angle sensor. While sensor 60 is described as being a pressure sensor, sensor 60 may be other devices that may be calibrated to provide a pressure signal that represents fuel pressure, such as a force transducer, strain gauge, or other device. The crank angle sensor may be a toothed wheel sensor 62, a rotary Hall sensor 64, or other type of device capable of measuring the rotational angle of crankshaft 20. Control system 18 uses signals received from accumulator pressure sensor 60 and the crank angle sensor to determine the combustion chamber receiving fuel, which is then used to analyze the signals received from accumulator pressure sensor 60, described in more detail hereinbelow.

Control module 56 may be an electronic control unit or electronic control module (ECM) that may monitor conditions of engine 10 or an associated vehicle in which engine 10 may be located. Control module 56 may be a single processor, a distributed processor, an electronic equivalent of a processor, or any combination of the aforementioned elements, as well as software, electronic storage, fixed lookup tables and the like. Control module 56 may include a digital or analog circuit. Control module 56 may connect to certain components of engine 10 by wire harness 58, though such connection may be by other means, including a wireless system. For example, control module 56 may connect to and provide control signals to inlet metering valve 52 and to fuel injectors 38.

When engine 10 is operating, combustion in combustion chambers 40 causes the movement of pistons 22, 24, 26, 28, 30, and 32. The movement of pistons 22, 24, 26, 28, 30, and 32 causes movement of connecting rods 34, which are drivingly connected to crankshaft 20, and movement of connecting rods 34 causes rotary movement of crankshaft 20. The angle of rotation of crankshaft 20 is measured by engine 10 to aid in timing of combustion events in engine 10 and for other purposes. The angle of rotation of crankshaft 20 may be measured in a plurality of locations, including a main crank pulley (not shown), an engine flywheel (not shown), an engine camshaft (not shown), or on the camshaft itself. Measurement of crankshaft 20 rotation angle may be made with toothed wheel sensor 62, rotary Hall sensor 64, and by other techniques. A signal representing the angle of rotation of crankshaft 20, also called the crank angle, is transmitted from toothed wheel sensor 62, rotary Hall sensor 64, or other device to control system 18.

Crankshaft 20 drives high-pressure fuel pump 46 and low-pressure fuel pump 50. The action of low-pressure fuel pump 50 pulls fuel from fuel tank 44 and moves the fuel along fuel circuit 42 toward inlet metering valve 52. From inlet metering valve 52, fuel flows downstream along fuel circuit 42 through inlet check valves (not shown) to high-pressure fuel pump 46. High-pressure fuel pump 46 moves the fuel downstream along fuel circuit 42 through outlet check valves 54 toward fuel accumulator or rail 48. Inlet metering valve 52 receives control signals from control system 18 and is operable to block fuel flow to high-pressure fuel pump 46. Inlet metering valve 52 may be a proportional valve or may be an on-off valve that is capable of being rapidly modulated between an open and a closed position to adjust the amount of fluid flowing through the valve.

Fuel pressure sensor 60 is connected with fuel accumulator 48 and is capable of detecting or measuring the fuel pressure in fuel accumulator 48. Fuel pressure sensor 60 sends signals indicative of the fuel pressure in fuel accumulator 48 to control system 18. Fuel accumulator 48 is connected to each fuel injector 38. Control system 18 provides control signals to fuel injectors 38 that determines operating parameters for each fuel injector 38, such as the length of time fuel injectors 38 operate and the number of fueling pulses per a firing or injection event period, which determines the amount of fuel delivered by each fuel injector 38.

Figure 2:
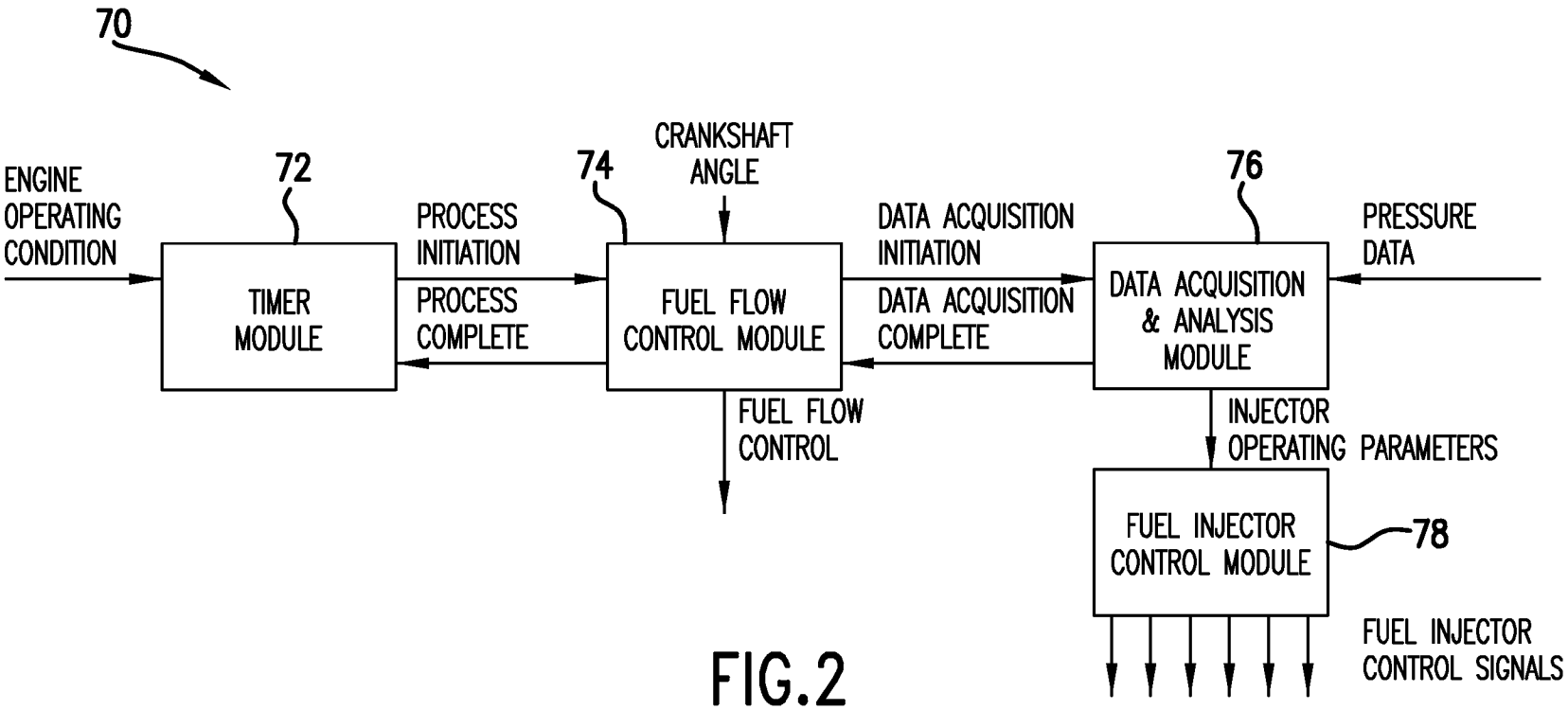
FIG. 2 is a data acquisition, analysis and control (DAC) module of the engine of FIG. 1 in accordance with an exemplary embodiment of the present disclosure.

Control system 18 includes a process that controls the components of engine 10 to enable measurement of fuel delivery by each individual fuel injector 38. Turning now to FIG. 2, a data acquisition, analysis and control (DAC) module 70 in accordance with an exemplary embodiment of the present disclosure is shown. DAC module 70 includes a timer module 72, a fuel flow control module 74, a data acquisition and analysis module 76, and a fuel injector control module 78.

Timer module 72 receives a signal indicative of the operating condition of engine 10 and a process complete signal from fuel flow control module 74. The function of timer module 72 is to initiate the data acquisition process of DAC module 70 when the operating condition of engine 10 permits and at a specific or predetermined interval. Timer module 72 also monitors the engine operating condition and may adjust the timing interval to include measurements under a variety of engine conditions, such as a variety of fueling quantities and accumulator pressure levels. Timer module 72 may also inhibit a new measurement if accumulator 48 remains at a constant pressure level or if fuel injectors 38 are commanded at the same fueling level, though such inhibitions may have a maximum length of time. Timer module 72 may also monitor the convergence of each fuel injector 38. A fuel injector 38 is converged when new measurements from the process described hereinbelow match the adapted or adjusted fueling characteristics, which means that the measurement interval may be increased to avoid unnecessary fuel flow stoppages. If convergence never occurs, the processes described below may indicate a system malfunction requiring operator intervention. Timer module may also limit the number of times fuel flow is stopped to avoid excessive fuel flow stoppages, which may be accomplished by overriding inlet metering valve 52. In order to initiate the data acquisition process, timer module 72 initiates or starts a timing process using either the operating condition of engine 10 or the completion of a previous data acquisition process. When engine 10 initially starts, timer module 72 receives an engine operating signal from control system 18 that indicates engine 10 is operating, which initiates a timer in timer module 72. When the timer reaches a specified or predetermined interval, which may be in the range of one to four hours and may be described as a drive cycle or an OBD (on-board diagnostics) cycle, timer module 72 transmits a process initiation signal to flow control module 74. Subsequent timing processes are initiated from the process complete signal received from flow control module 74.

Fuel flow control module 74 receives the process initiation signal from timer module 72, a data acquisition complete signal from data acquisition and analysis module 76, and a crankshaft angle signal from control system 18. Flow control module 74 provides the process complete signal to timer module 72, a data acquisition initiation signal to data acquisition and analysis module 76 and a flow control signal to fuel system 16. The process initiation signal from timer module 72 causes flow control module 74 to wait for a predetermined crankshaft angle and, once the predetermined angle is reached, to send a fuel flow control signal to fuel system 16 that stops the fuel flow to accumulator 48, forming the start of a termination event. After transmitting the signal to stop fuel flow, flow control module 74 then sends the data acquisition initiation signal to data acquisition and analysis module 76. The data acquisition complete signal from data acquisition and analysis module 76 causes flow control module 74 to send the fuel flow control signal to fuel system 16 that re-starts the fuel flow to accumulator 48, ending the termination event. After transmitting the signal to re-start fuel flow, flow control module 74 transmits the process complete signal to timer module 72.

Data acquisition and analysis module 76 receives the data acquisition initiation signal from flow control module 76 and a fuel pressure data signal from fuel rail or accumulator pressure sensor 60, and provides one or more injector operating parameter signals to fuel injector control module 78 and the data acquisition complete signal to flow control module 74. When data acquisition and analysis module 76 receives the data acquisition initiation signal from flow control module 76, module 76 begins to store fuel pressure data signals from accumulator pressure sensor 60. Module 76 will acquire the fuel pressure data signals and analyze the fuel pressure data signals to determine when a predetermined fuel pressure decrease has been reached. Once the predetermined fuel pressure decrease has been reached, module 76 will complete the analysis of the fuel pressure data signals to determine whether the operating parameters for one or more fuel injectors 38 needs to be modified, described further hereinbelow. If one or more operating parameters for any fuel injector 38 require adjustment, module 76 will transmit the modified fuel injector operating parameters to fuel injector control module 78 for use in subsequent fuel injection events. Data acquisition and analysis module 76 also sends the data acquisition complete signal to flow control module 74.

Fuel injector control module 78 receives fuel injector operating parameters from data acquisition and analysis module 76 and provides signals to each fuel injector 38 that control the operation of each fuel injector 38. For example, the operating parameters may include the time of operation for each fuel injector 38, the number of fueling pulses from a fuel injector 38, and placement of a fuel injection event with respect to the crank angle or crankshaft angle. Though not shown, fuel injection control module 78 also receives information regarding a desired fuel quantity, desired start-of-injection timing, and other information that may be needed to control the operation of each fuel injector 38 properly.

Figure 3:
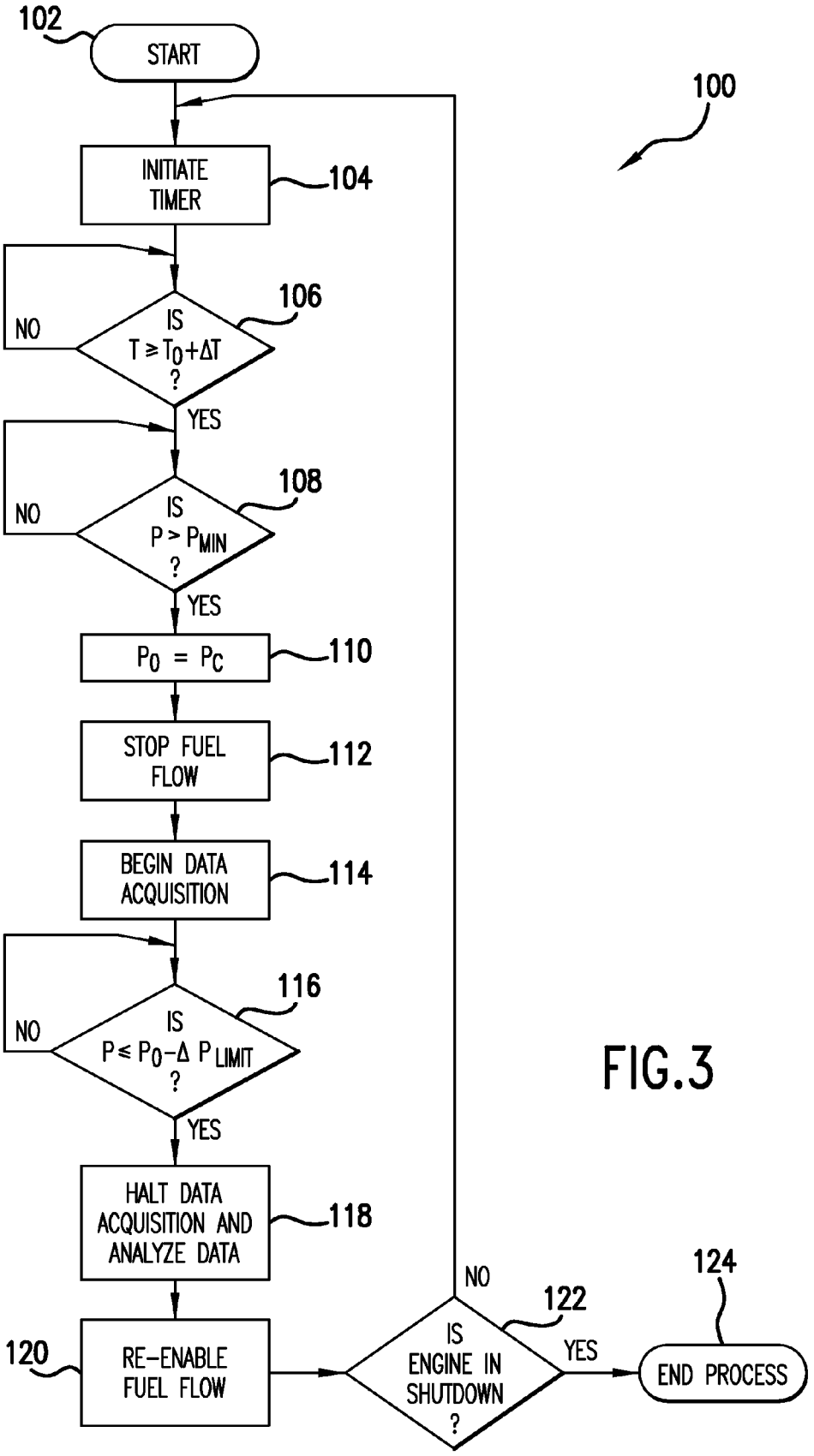
FIG. 3 is a process flow diagram for a data acquisition process of the DAC module of FIG. 2 in accordance with a first exemplary embodiment of the present disclosure.

Turning now to FIG. 3, a flow diagram describing a data acquisition process 100 of control system 18 in accordance with a first exemplary embodiment of the present disclosure is shown. Data acquisition process 100 may be distributed in one or more modules of control system 18, such as timer module 72, flow control module 74, and data acquisition and analysis module 76. Data acquisition process 100 is likely to be part of a larger process incorporated in control module 56 that controls some or all of the functions of engine 10. Thus, while FIG. 3 shows data acquisition process 100 as a self-contained process, it is likely that data acquisition process 100 is "called" by a larger process, and at the completion of data acquisition process 100 control is handed back to the calling process.

Data acquisition process 100 initiates with a process 102. Process 102 may include setting variables within data acquisition process 100 to an initial value, clearing registers, and other functions necessary for the proper functioning of data acquisition process 100. From process 102, control passes to a process 104. At process 104, a timer is initiated and a time $T_0$ is set. Data acquisition process 100 may use another timing function of engine 10 to establish an initial time $T_0$ for the requirements of data acquisition process 100. For convenience of explanation, the timing function is described as part of data acquisition process 100.

Data acquisition process 100 continues with a decision process 106. At process 106, data acquisition process 100 determines whether the current time T is equal to or greater than $T_0$ plus a predetermined or specific change in time $\Delta T$ since the timer initiated. In an exemplary embodiment of the disclosure, $\Delta T$ may be one hour. The time period may be greater or less than one hour, depending on measured changes in fuel delivered or on other conditions. While $\Delta T$ is described in this disclosure as a fixed or predetermined value, $\Delta T$ may be varied based on actual data. For example, if no adjustments to fuel injector 38 parameters are required for a lengthy period, such as one hour or more, $\Delta T$ may be incremented to a higher value, such as 30 minutes, by the action of one of the modules described herein. If $\Delta T$ is less than $T_0$ plus $\Delta T$, data acquisition process 100 waits at decision process 106 until the present time is greater than or equal to $T_0$ plus $\Delta T$. As with initial time $T_0$, this timing function may be performed elsewhere in engine 10 and is included in this process for convenience of explanation. Once the condition of decision process 106 has been met, the process moves to a decision process 108.

At decision process 108, data acquisition process 100 determines whether the fuel pressure P in fuel accumulator 48 is greater than minimum fuel pressure $P_{MIN}$. The purpose of process 108 is to verify that there is sufficient fuel pressure in fuel accumulator 48 to guarantee collection of valid data for at least one piston. Thus, if the fuel pressure in fuel accumulator 48 is near a pressure level that will be insufficient for proper operation of fuel injectors 38, data acquisition process 100 will wait until high-pressure fuel pump 46 has increased the fuel pressure in fuel accumulator 48 to a suitable fuel pressure level. The minimum fuel pressure will depend on many factors, particularly the type of engine, the amount of fuel each fuel injector 38 typically delivers, and the capacity of high-pressure fuel pump 46. If fuel injectors 38 operate most efficiently with accumulator fuel pressure at 1,500 bar, then $P_{MIN}$ may be set at a normal operating fuel pressure of 1,600 bar or higher to assure accumulator 48 contains a normal operating fuel pressure even under high load conditions. In an exemplary embodiment, $P_{MIN}$ is 500 bar. Data acquisition process 100 moves to a process 110 once the fuel pressure in fuel accumulator 48 has reached $P_{MIN}$.

At process 110, data acquisition process 100 sets fuel pressure $P_0$ to the current fuel pressure $P_C$ in fuel accumulator 48. Data acquisition process 100 then moves to a process 112. At process 112, control system 18 sends a control signal to inlet metering valve 52 to close, stopping fuel flow to high-pressure fuel pump 46, forming the start of a termination event. Control system 18 begins storing signals from accumulator pressure sensor 60 at a process 114, beginning with crank angle 0 degrees plus an offset, which may be 20 degrees. The purpose of the offset is to accommodate the length of time it takes for inlet metering valve 52 to respond, and may also accommodate timing of fuel injection events. Data acquisition will proceed through the firing sequence, which may be piston 22, piston 30, piston 26, piston 32, piston 24, and piston 28, or piston #1, piston #5, piston #3, piston #6, piston #2, and piston #4. At a decision process 116, data acquisition process 100 determines whether the fuel pressure in fuel accumulator 48 is less than or equal to $P_0$ minus $\Delta P_{Limit}$, where $\Delta P_{Limit}$ is the maximum total fuel pressure decrease permissible in fuel accumulator 48. Once the condition of decision process 116 has been met, data acquisition process 100 moves to a process 118, where data acquisition from accumulator pressure sensor 60 is stopped, and the signals or data acquired is analyzed by control system 18, described in more detail hereinbelow. Though not shown in data acquisition process 100, process 100 may include an additional process during the data acquisition process that aborts the cutout event if the accumulator pressure drops below a preset level, regardless of any other condition. Data acquisition process 100 may also include a process that provides for multiple fuel cutout events, with each cutout event separated by an adjustable or calibratible interval, e.g., 15 seconds.

At a process 120, control system 18 sends a signal to inlet metering valve 52 to open, restore, enable, re-enable, start, or re-start fuel flow to high-pressure fuel pump 46 and fuel accumulator 48 and ending the termination event. While process 120 is shown as occurring after analysis of data in process 118, process 120 may be implemented first and then analysis of the data if the fuel flow to accumulator needs re-enabled quickly for operational reasons. At a decision process 122, data acquisition process 100 determines whether engine 10 is in a shutdown mode. If engine 10 is shutting down, then measurement of fuel delivery by fuel injectors 38 is no longer desirable and may lead to invalid data, so data acquisition process 100 ends at a process 124. If engine 10 is continuing to operate, data acquisition process 100 returns to process 104, where the timer is restarted and data acquisition process 100 continues as previously described.

While data acquisition process 100 is described in the context of six pistons, data acquisition process 100 may be used for any number of pistons. The only adjustment required for the process to function properly is to provide the crank angles for firing of the pistons, and the firing order.

Figure 4:
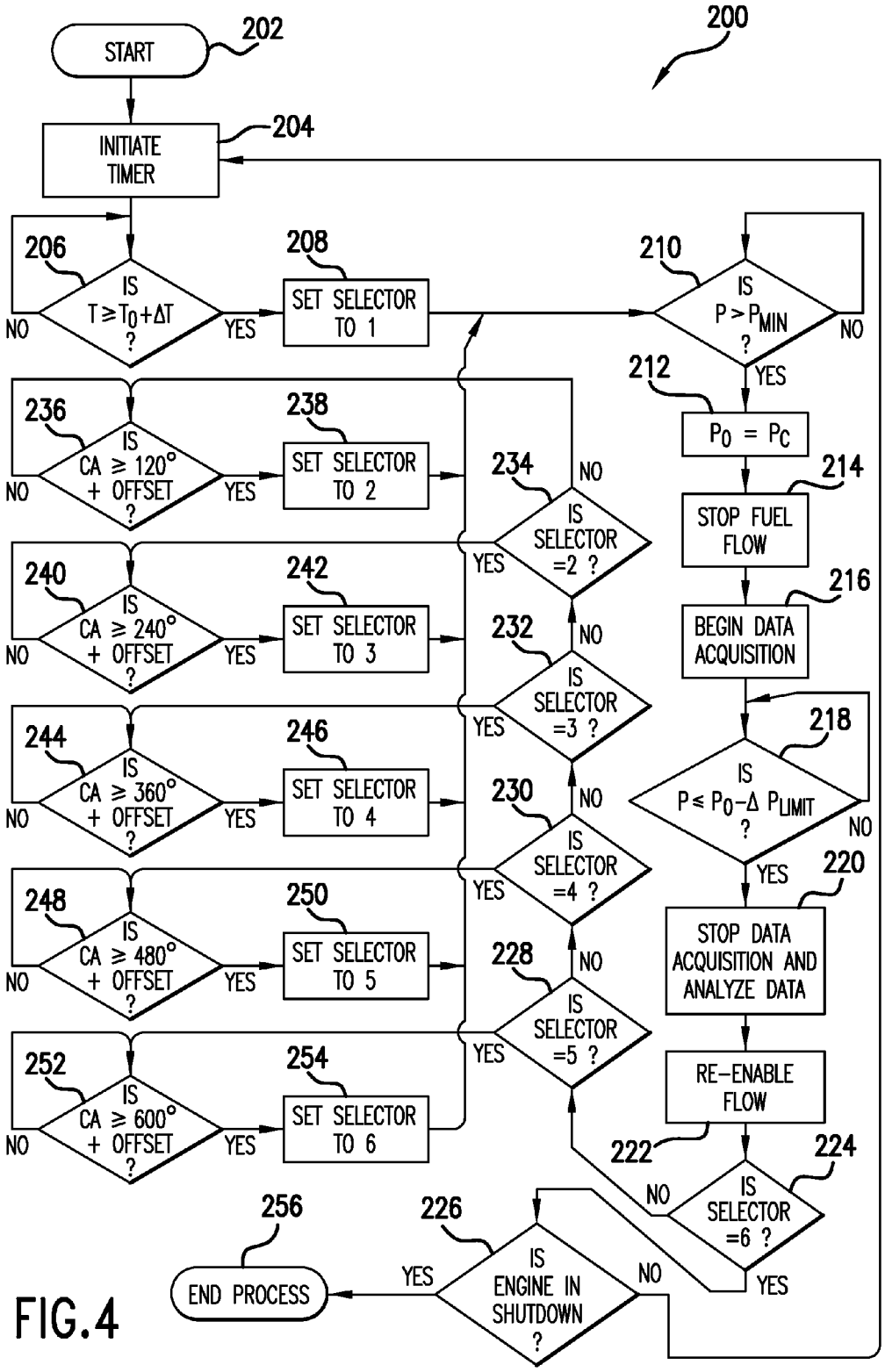
FIG. 4 is a process flow diagram for a data acquisition process of the DAC module of FIG. 2 in accordance with a second exemplary embodiment of the present disclosure.

While data acquisition process 100 works well, because the total fuel pressure decrease in fuel accumulator 48 caused by injection events is restricted to $\Delta P_{Limit}$, data may not be acquired from certain pistons because flow will be restarted before acceptable data is received from at least six pistons. A data acquisition process 200 shown in FIG. 4 in accordance with a second exemplary embodiment of the present disclosure addresses the risk that data from certain pistons may be limited by stopping fuel flow from high-pressure pump 46 at varying positions of crankshaft 20. As with data acquisition process 100, data acquisition process 200 is likely to be part of a larger process incorporated in control module 56 that controls all the functions of engine 10. Thus, while FIG. 4 shows data acquisition process 200 as a self-contained module, it is likely that data acquisition process 200 is "called" by a larger process and at the completion of data acquisition process 200 control is handed back to the calling process.

Data acquisition process 200 initiates with a process 202. Process 202 may include setting variables within data acquisition process 200 to an initial value, clearing registers, and other functions necessary for the proper functioning of data acquisition process 200. From process 202, control passes to a process 204. At process 204, a timer is initiated and a time $T_0$ is set. Data acquisition process 200 may use another timing function of engine 10 to establish an initial time $T_0$ for the requirements of data acquisition process 200. For convenience of explanation, the timing function is described as part of data acquisition process 200.

A decision process 206 is next in the process. At process 206, data acquisition process 200 determines whether the current time T is equal to or greater than $T_0$ plus a specified or predetermined change in time ΔT since the timer initiated. In an exemplary embodiment of the disclosure, ΔT may be one hour. The time period may be greater or less than one hour, depending on measured changes in fuel delivered or on other conditions. If ΔT is less than $T_0$ plus ΔT, data acquisition process 200 waits until the present time is greater than or equal to $T_0$ plus ΔT. While ΔT is described in this disclosure as a fixed or predetermined value, ΔT may be varied based on actual data. For example, if no adjustments to fuel injector 38 parameters are required for a lengthy period, such as one hour or more, ΔT may be incremented to a higher value, such as 30 minutes, by the action of one of the modules described herein. As with initial time, $T_0$, this timing function may be performed elsewhere in engine 10 and is included in data acquisition process 200 for convenience of explanation. Once the condition of decision process 206 has been met, data acquisition process 200 moves to a process 208, where a selector value is set to 1. Data acquisition process 200 then moves to a decision process 210.

At decision process 210, data acquisition process 200 determines whether the fuel pressure P in fuel accumulator 48 is greater than minimum fuel pressure $P_{MIN}$. The purpose of process 210 is to verify that there is sufficient fuel pressure in fuel accumulator 48 to guarantee collection of valid data for at least one piston. Thus, if the fuel pressure in fuel accumulator 48 is near a pressure level that will be insufficient for proper operation of fuel injectors 38, data acquisition process 200 will wait until high-pressure fuel pump 46 has increased the fuel pressure in fuel accumulator 48 to a suitable pressure level. The minimum fuel pressure will depend on many factors, particularly the type of engine, the amount of fuel each fuel injector 38 typically delivers, and the capacity of high-pressure fuel pump 46. If fuel injectors 38 operate most efficiently with accumulator fuel pressure at 1,500 bar, then $P_{MIN}$ may be set at a normal operating fuel pressure of 1,600 bar or higher to assure accumulator 48 contains a normal operating fuel pressure even under high load conditions. Data acquisition process 200 moves to a process 212 once the fuel pressure in fuel accumulator 48 has reached $P_{MIN}$.

At process 212, data acquisition process 200 sets fuel pressure $P_0$ to the current fuel pressure $P_C$ in fuel accumulator 48. Data acquisition process 200 then moves to a process 214. At process 214, control system 18 sends a control signal to inlet metering valve 52 to close, stopping fuel flow to high-pressure fuel pump 46, which is the start of a termination event. Control system 18 begins storing signals from accumulator pressure sensor 60 at a process 216, beginning with the crank angle set by the selector value. For a selector value of 1, data collection begins with a crank angle of 0 degrees plus an offset, which may be 20 degrees, as in the example of data acquisition process 100. Data acquisition will then proceed through the firing sequence, which may be piston 22, piston 30, piston 26, piston 32, piston 24, and piston 28, or piston #1, piston #5, piston #3, piston #6, piston #2 and piston #4. At a decision process 218, data acquisition process 200 determines whether the fuel pressure in fuel accumulator 48 is less than or equal to $P_0$ minus $\Delta P_{Limit}$, where $\Delta P_{Limit}$ is the maximum total fuel pressure decrease permissible in fuel accumulator 48. Once the condition of decision process 218 has been met, data acquisition process 200 moves to a process 220, where data acquisition from accumulator pressure sensor 60 is stopped, and the signals or data acquired is analyzed by control system 18, described in more detail hereinbelow.

At a process 222, control system 18 sends a signal to inlet metering valve 52 to open, restoring or re-enabling fuel flow to high-pressure fuel pump 46 and fuel accumulator 48 and ending the termination event. At a decision process 224, data acquisition process 200 determines whether the selector value is 6, which would indicate that timing of the data acquisition process has started at least once with each of the six pistons of engine 10. If the selector value is 6, data acquisition process 200 moves to a decision process 226, where data acquisition process 200 determines whether engine 10 is in a shutdown mode. If engine 10 is shutting down, then measurement of fuel delivery by fuel injectors 38 is no longer desirable and may lead to invalid data, so data acquisition process 200 ends at a process 256. If engine 10 is continuing to operate, data acquisition process 200 returns to process 204, where the timer is restarted and data acquisition process 200 continues as previously described.

Returning to decision process 224, if the selector value is not equal to 6, then control passes to a decision process 228, a decision process 230, a decision process 232, and a decision process 234. In the present example, the selector value was last set to 1, so control will pass from decision process 234 to a decision process 236. At decision process 236, data acquisition process 200 waits for a crank angle of 120 degrees plus an offset to accommodate timing of injector firing. Once the proper crank angle is achieved, data acquisition process 200 moves to a process 238, where the selector value is set to 2.

Data acquisition process 200 continues with decision process 210, as previously described. The only difference is that with a selector value of 2, data acquisition at process 216 will begin at a crank angle of approximately 120 degrees plus the offset, which corresponds with piston 30, which is also piston #5 in a six-cylinder engine. Data acquisition process 200 will then proceed through the previously described decision processes to decision process 234, where data acquisition process 200 will move to a decision process 240 because the selector value is now 2. At decision process 240, data acquisition process 200 waits until a crank angle of 240 degrees plus the previously described offset is achieved. Once the proper crank angle is reached, data acquisition process 200 moves to a process 242, where the selector value is set to 3. Data acquisition process 200 then follows the previously described processes, with data acquisition beginning at a crank angle of 240 degrees plus the previously described offset.

Data acquisition process 200 will continue in this manner, reaching a decision process 244 and setting the selector value to 4 at a process 246, reaching a decision process 248 and setting the selector value to 5 at a process 250, and finally reaching a decision process 252 and setting the selector value to 6 at a process 254. With a selector value of 6, when data acquisition process 200 reaches decision process 224, control will be passed to decision process 226 and then to process 204, if engine 10 is continuing to operate. Once at process 204, data acquisition process 200 will continue to operate as previously described.

As with data acquisition process 100, data acquisition process 200 is adjustable to accommodate more or less pistons by increasing or decreasing the number of processes associated with different crank angles, by changing the crank angles associated with fuel injection, and by changing the final selector value in decision process 224. In this manner, data acquisition may begin with a different piston each time, assuring adequate data collection from all pistons, particularly in a high load condition where data from only one or two pistons may be acquired during a period where fuel flow from high-pressure fuel pump 46 is stopped.

Figure 5:
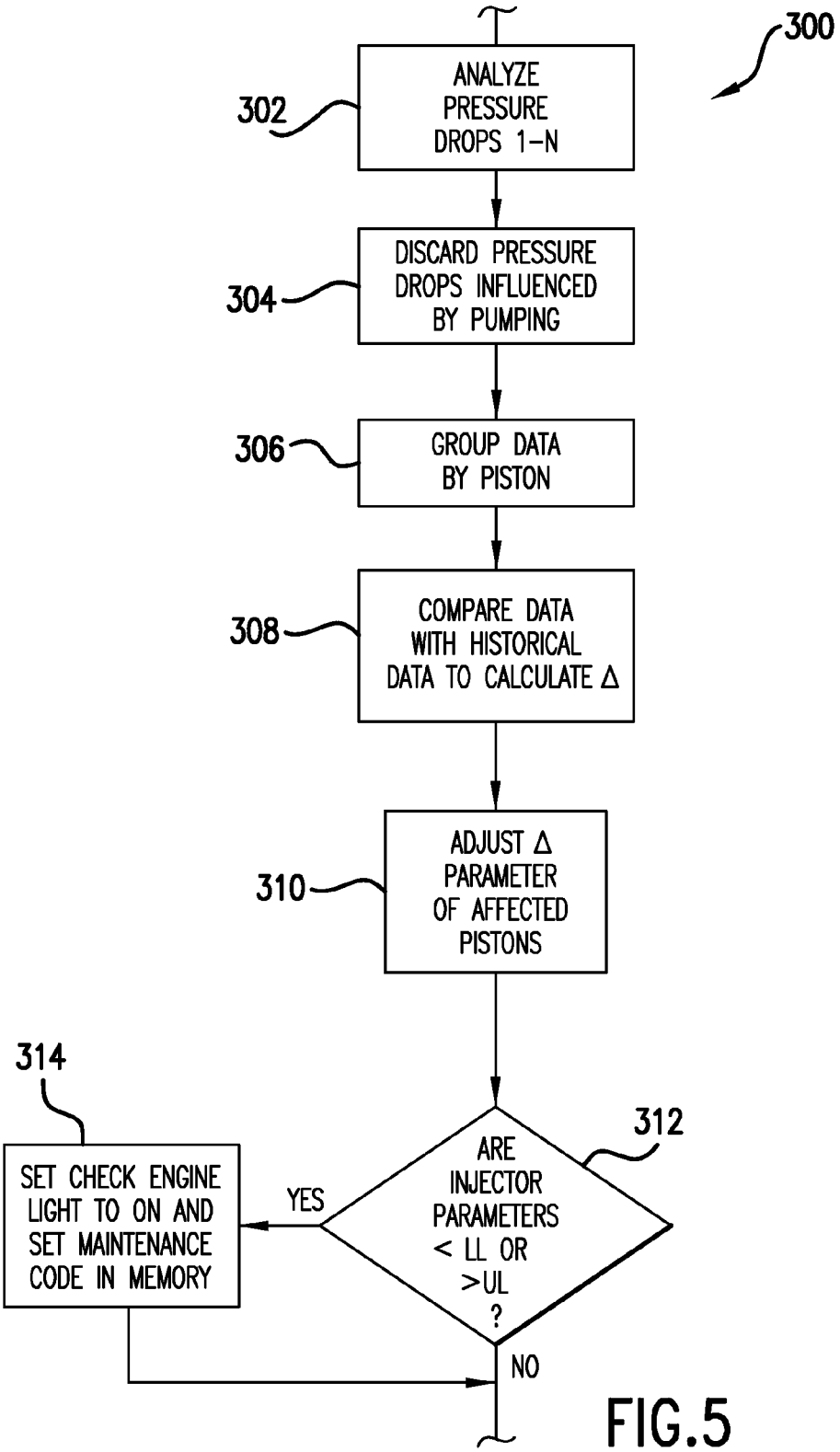
FIG. 5 is a process flow diagram for a data analysis process of FIGS. 3 and 4 in accordance with an exemplary embodiment of the present disclosure.

While there are differences between data acquisition process 100 and 200, the actual process of analyzing data may be the same between the two processes. A data analysis process 300 shown in FIG. 5 is a representative data analysis process performed in process 118 of data acquisition process 100 and process 220 of data acquisition process 200.

In a process 302, data analysis process 300 identifies the available fuel pressure decreases acquired during the data acquisition process, described further hereinbelow, and associates those fuel pressure decreases with particular pistons. At a process 304, data analysis process 300 discards any fuel pressure decreases that may be influenced by pumping of fuel from high-pressure fuel pump 46. After inlet metering valve 52 is closed, there may be residual fuel in high-pressure fuel pump 46 that will flow to fuel accumulator 48, affecting the fuel pressure in fuel accumulator 48. Because the fuel flow affects the calculation of fuel pressure decrease due to an injection event, any such fuel pressure decrease is discarded when it is calculated to have happened.

At a process 306, all data acquired is grouped by piston. Note that while the focus is on piston numbers for data collection, organization and analysis, organization could also be by fuel injectors, combustion chambers, etc., as long as the firing order is clearly defined and associated with crank angle. Also, note that the fuel pressure decrease data is used to calculate the quantity of fuel delivered by a fuel injector in a known manner. In any set of fuel pressure decrease data acquired, there may be no data for a particular piston, and there may be multiple sets of data from a particular piston, which will be explained in more detail hereinbelow. Data analysis process 300 may perform additional processes with fuel pressure decrease data, such as averaging all available data for a piston over a plurality of predetermined intervals, such as data collected over the last hour. Such averaging might be performed to reduce noise that occurs in such data.

At a process 308, the current and/or recently collected data for each piston is compared with historical data for that piston to determine any difference with current and/or recently collected data. From process 308, data analysis process 300 moves to a process 310, where control parameters for each fuel injector 38 associated with the one or more pistons for which data was collected and analyzed are adjusted for future injection events. Such control parameters may include an injector on-time, number of firing pulses, and/or placement of a fuel injection event with respect to the crank angle.

From process 310, data analysis process 300 moves to a decision process 312. At decision process 312, data analysis process 300 compares the parameters of each fuel injector, which may include a fueling characteristic, with predetermined upper limits (UL) and lower limits (LL), which thus forms a range of operation for each fuel injector 38. The fueling characteristic may be defined as a quantity of fuel delivered versus an actuation duration. The fueling characteristic may take the form of one or more equations and/or an adaptive look-up table. If any parameter of any fuel injector 38 falls outside the predetermined limits or range, which may include a trim limit, data analysis process 300 moves to a process 314. At process 314, data analysis process 300 may set an operator indicator, such as a "CHECK ENGINE," "SERVICE ENGINE SOON," or other indicator visible to an operator of engine 10. Data analysis process 300 may also set a maintenance code in a memory of control system 18, indicating that a particular fuel injector's operating parameters have exceeded a predetermined range. After process 314 or after process 312, the data analysis process performed in process 118 of data acquisition process 100 and process 220 of data acquisition process 200 is complete, and the associated processes continue as previously described.

Figure 6:
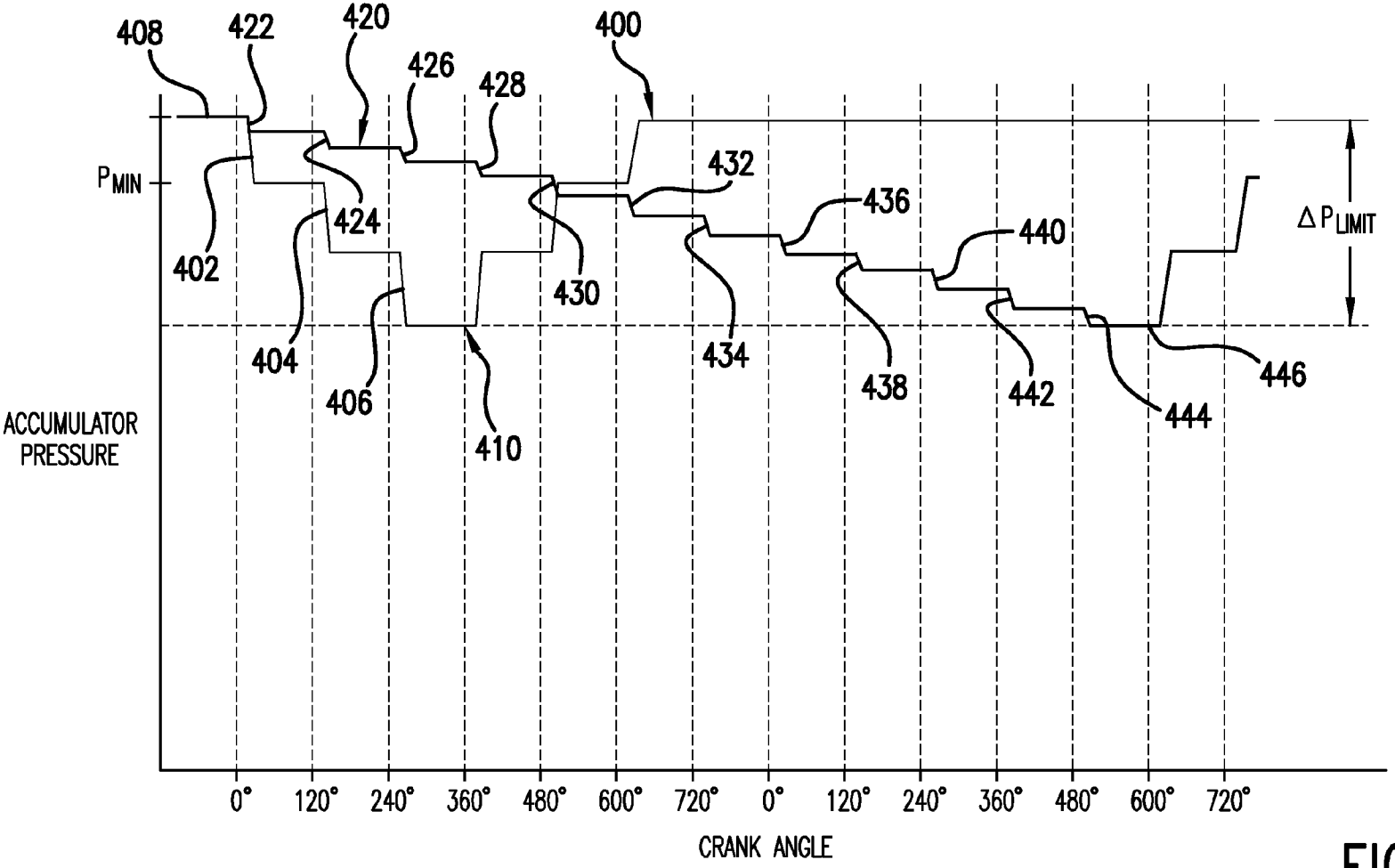
FIG. 6 is a graph showing data acquired during cessation of fuel flow to an accumulator of the internal combustion engine of FIG. 1.

FIG. 6 shows representative data acquired during the operation of the previously described processes. The horizontal axis of FIG. 6 shows the crank angle of engine 10. The vertical axis shows relative fuel pressures of fuel accumulator 48. The value $P_{Min}$, which is used in process 108 of data acquisition process 100 and process 210 of data acquisition process 200, is shown on the vertical axis. The value $\Delta P_{Limit}$, which sets the maximum total fuel pressure decrease permissible in fuel accumulator 48, is shown on the right hand side of the graph in FIG. 6.

Two representative sets of data are shown in FIG. 6. Data curve 400 is data that may be collected when engine 10 is under a high load condition and the amount of fuel injected per injection event is high. Slope 402 is an injection event for fuel injector 38 associated with piston 22. Slope 404 is an injection event for fuel injector 38 associated with piston 30. Slope 406 is an injection event for fuel injector 38 associated with piston 26. Note that because the cessation of fuel delivery to fuel accumulator 48 is based on the total fuel pressure decrease, i.e., $\Delta P_{Limit}$, data curve 400 contains fuel pressure decreases from only three pistons. Fuel flow to high-pressure fuel pump 46 is stopped at point 408. Fuel flow to high-pressure fuel pump 46 is restored at point 410. Process 304 of data analysis process 300 may determine that slope 402 is affected by pumping from high-pressure fuel pump 46 and may discard the fuel pressure decrease that slope 402 represents. Thus, in this example only two useful data points are available.

Data curve 420 is data that may be collected when engine 10 is under a lower load condition than data curve 400 and the amount of fuel injected per injection event is low. Slopes 422 and 434 are injection events for fuel injector 38 associated with piston 22. Slopes 424 and 436 are injection events for fuel injector 38 associated with piston 30. Slopes 426 and 438 are injection events for fuel injector 38 associated with piston 26. Slopes 428 and 440 are injection events for fuel injector 38 associated with piston 32. Slopes 430 and 442 are injection events for fuel injector 38 associated with piston 24. Slopes 432 and 44 are injection events for fuel injector 38 associated with piston 28. Because the amount of fuel, which directly correlates to fuel pressure, is less per injection event under this lower load condition, data curve 420 contains twelve data points that were collected during the total fuel pressure decrease $\Delta P_{Limit}$. As before, the fuel flow to high-pressure fuel pump 46 is stopped at point 408. Fuel flow to high-pressure fuel pump 46 is restored at point 446 on data curve 420. Process 304 of data analysis process 300 may determine that slope 422 is affected by pumping from high-pressure fuel pump 46 and may discard the fuel pressure decrease that slope 402 represents. Thus, in this example, while twelve fuel pressure decreases were collected, only eleven may be useful.

While various embodiments of the disclosure have been shown and described, it is understood that these embodiments are not limited thereto. The embodiments may be changed, modified and further applied by those skilled in the art. Therefore, these embodiments are not limited to the detail shown and described previously, but also include all such changes and modifications.

We claim:

1. A system for determining a fuel quantity delivered to a plurality of combustion chambers by a fuel system of an internal combustion engine, the system comprising:

a fuel accumulator positioned to receive a fuel flow at an operating fuel pressure;

a sensor adapted to detect the operating pressure in the fuel accumulator and to transmit a pressure signal indicative of the operating fuel pressure in the fuel accumulator;

a plurality of fuel injectors, each fuel injector operable to deliver a quantity of fuel from the fuel accumulator to one of the plurality of combustion chambers; and a control system adapted to receive the pressure signal during at least one load condition of the engine, to transmit a control signal to stop the fuel flow to the fuel accumulator during the at least one load condition, to analyze the pressure signal to determine the quantity of fuel delivered by one or more of the plurality of fuel injectors during the at least one load condition, to transmit a control signal to restart the fuel flow to the fuel accumulator after the fuel pressure in the fuel accumulator has decreased by a predetermined amount during the at least one load condition, to adjust an operating parameter of at least one of the plurality of fuel injectors based on the analysis of the pressure signal, to monitor convergence of the at least one fuel injector, and to increase a length of time between transmissions of the control signal to stop the fuel flow to the at least one fuel injector based on the convergence of the fuel accumulator.

2. The system of claim 1, further including an inlet metering valve, the inlet metering valve adapted to receive the control signal from the control system to stop the fuel flow to the accumulator.

3. The system of claim 1, wherein the control system adjusts an operating parameter of at least one of the plurality of fuel injectors based on the analysis of the pressure signal.

4. The system of claim 1, the internal combustion engine including a crankshaft and wherein the fuel flow is stopped at a predetermined crankshaft angle.

5. The system of claim 4, wherein the fuel flow is stopped at a non-zero crankshaft angle.

6. The system of claim 1, wherein the fuel flow is stopped at a predetermined interval.

7. The system of claim 6, wherein the predetermined interval is one hour after a timer is initiated.

8. The system of claim 7, wherein the pressure signal is received and analyzed by the control system over a plurality of predetermined intervals and the quantity of fuel delivered is averaged over the plurality of predetermined intervals.

9. The system of claim 1, wherein the fuel flow is stopped only if the operating fuel pressure in the fuel accumulator is above a minimum fuel pressure level.

10. The system of claim 1, wherein the operating fuel pressure decrease is measured from a current operating fuel pressure in the fuel accumulator.

11. A method of determining an amount of fuel injected by a fuel injector of an internal combustion engine, the method comprising:

providing a fuel flow to a fuel accumulator at an operating fuel pressure;

stopping, during at least one load condition of the engine, the fuel flow to the fuel accumulator to define a beginning of a termination event;

determining, during the at least one load condition, the operating fuel pressure in the fuel accumulator during the termination event;

restarting, during the at least one load condition, the fuel flow to the fuel accumulator when the operating fuel pressure in the fuel accumulator decreases by a predetermined amount, defining an end of the termination event;

determining, during the at least one load condition, the amount of fuel delivered by the fuel injector during a fuel injection event from the operating fuel pressure;

adjusting an operating parameter of at least one of the plurality of fuel injectors based on the analysis of the pressure signal;

monitoring convergence of the at least one fuel injector; and increasing a length of time between transmissions of the control signal to stop the fuel flow to the fuel accumulator based on the convergence of the at least one fuel injector.

12. The method of claim 11, wherein an operating parameter of the fuel injector is modified to change the amount of fuel delivered by the fuel injector during a subsequent fuel injection event.

13. The method of claim 11, wherein the fuel flow is stopped at a predetermined interval.

14. The method of claim 11, wherein the amount of fuel delivered is averaged over a plurality of termination events.

15. The method of claim 11, wherein the fuel flow is stopped only if the fuel pressure in the fuel accumulator is above a minimum fuel pressure level.

16. The method of claim 11, wherein the operating fuel pressure decrease is measured from a current operating fuel pressure in the fuel accumulator.

17. The method of claim 11, the internal combustion engine including a control system and wherein the control system adjusts an operating parameter of the fuel injector to modify the amount of fuel delivered by the fuel injector during a subsequent fuel injection event.

18. The method of claim 11, wherein the internal combustion engine includes a control system and an inlet metering valve positioned to control the fuel flow to the fuel accumulator and the fuel flow is stopped by sending a control signal from the control system to the inlet metering valve.

19. The method of claim 11, wherein the internal combustion engine further includes a crankshaft and wherein the fuel flow is stopped at a predetermined crankshaft angle.

20. The method of claim 19, wherein the fuel flow is stopped at a non-zero crankshaft angle.

21. The system of claim 1, wherein the control system is further adapted to stop the fuel flow to the fuel accumulator when the operating fuel pressure is a minimum operating fuel pressure.

* * * * *